US005715790A

United States Patent [19]

Tolley et al.

[11] Patent Number: 5,715,790

[45] Date of Patent: Feb. 10, 1998

[54] CONTROLLER FOR INTERNAL COMBUSTION ENGINE

[75] Inventors: Alan Philip Tolley, Essex CMO 8DD; Simon David Stevens, Birmingham B13 ODP, both of Great Britain

[73] Assignee: New Holland North America, Inc., New Holland, Pa.

[21] Appl. No.: 734,893

[22] Filed: Oct. 22, 1996

[30] Foreign Application Priority Data

Oct. 25, 1995 [GB] United Kingdom ..... 9521846

[51] Int. Cl.[6] ..... F02D 41/02

[52] U.S. Cl. ..... 123/396

[58] Field of Search ..... 123/357, 396, 123/352, 492

[56] References Cited

U.S. PATENT DOCUMENTS 5,025,770 6/1991 Richardson ..... 123/585

*Primary Examiner*—Willis R. Wolfe

*Assistant Examiner*—Hieu T. Vo

*Attorney, Agent, or Firm*—Larry W. Miller; Frank A. Seemar; John W. Stader

[57] ABSTRACT

A controller system is provided for controlling the power boost operation of an internal combustion engine by increasing fuelling, the controller means comprising a fuel controller for controlling the rate of fuel supplied to the engine and for supplying an increased rate of fuel in response to a power boost demand signal. The controller system further includes a first timer for measuring a first time period during which the power boost signal is supplied to the fuel controller, a comparator for supplying a prevent boost signal when the first time period exceeds a maximum boost time period, and a second timer for preventing the fuel controller from supplying the increased rate of fuel for a second time period in response to the prevent boost signal.

15 Claims, 3 Drawing Sheets

CONTROLLER FOR INTERNAL COMBUSTION ENGINE

BACKGROUND OF THE INVENTION

The present invention relates to a controller for controlling a power boost operation of an internal combustion engine. Such a controller may be used as part of an engine management system, for instance for a compression-ignition engine of an agricultural tractor.

Agricultural tractors generally have a compression-ignition engine controlled by a manually operated throttle control. A mechanical or electronic governor senses the engine speed and forms part of a feedback control system for maintaining the engine speed substantially at a value selected by the manual throttle control. The fuelling of the engine is controlled up to a maximum normal value so as to maintain the engine speed substantially constant irrespective of the load applied to the tractor.

In some applications, such as during ploughing of agricultural land, the load applied to the tractor may be too great for the engine speed to be maintained within the maximum permitted continuous power output of the tractor. In such circumstances, it is possible to manually select power boost operation in which the fuelling of the engine may be increased so as to boost the power output beyond the normal maximum continuous rating. However, because of the increased work done by the engine, the coolant system of the engine cannot maintain the temperature of the engine indefinitely below a maximum permitted operating temperature.

SUMMARY OF THE INVENTION

It is therefore an object of the present invention to provide a controller for power boost operation which automatically prevents overheating of the engine by limiting power boost operation when necessary.

According to a first aspect of the invention, there is provided controller means for controlling power boost operation of an internal combustion engine by increasing fuelling, said controller means including a fuel controller for controlling the rate of fuel supplied to the engine and for supplying an increased rate of fuel in response to a power boost demand signal.

The invention is characterized in that the controller means further includes a first timer for measuring a first time period during which the power boost demand signal is supplied to the fuel controller, a comparator for supplying a prevent boost signal when the first time period exceeds a maximum boost time period, and a second timer for preventing the fuel controller from supplying the increased rate of fuel for a second time period in response to the prevent boost signal.

The maximum boost period may be dependent on the amount of power boost demanded by the power boost demand signal or may be dependent on ambient temperature.

The second time period may be constant. Alternatively, the second time period may be variable and may, for example, be dependent on ambient temperature, the amount of boost demanded by the power boost demand signal, the recent history of power boost operation, or any combination of these parameters.

The first and second timers may include a counter arranged to count from a first predetermined count towards a second predetermined count in the presence of the power boost demand signal and to count towards the first predetermined count in the absence of the power boost demand signal or when the counter reaches the second predetermined count. Where the maximum boost period and the second time period are variable, the rate of counting may be varied, for instance by supplying clock pulses of variable repetition rate.

It is thus possible to provide a controller which provides automatic monitoring and control of power boost operation. Such a controller may be used to optimize the power boost operation while preventing overheating of the engine.

According to a second aspect of the invention, a method is provided of controlling a power boost operation of an internal combustion engine by increasing fuelling, said engine having a fuel controller for controlling the rate of fuel supplied to the engine.

The method is characterized in that it includes the steps of generating a power boost demand signal; timing a first time period during which said power boost demand signal is generated; supplying an increased rate of fuel to said engine during said first time period; generating a prevent boost signal when said first time period exceeds a maximum boost time period; and preventing said supplying step for a timed second time period in response to said prevent boost signal being generated.

BRIEF DESCRIPTION OF THE DRAWINGS

The present invention will now be described in greater detail, by way of example, with reference to the accompanying drawings, wherein.

DETAILED DESCRIPTION OF THE PREFERRED EMBODIMENT

Figure 1:
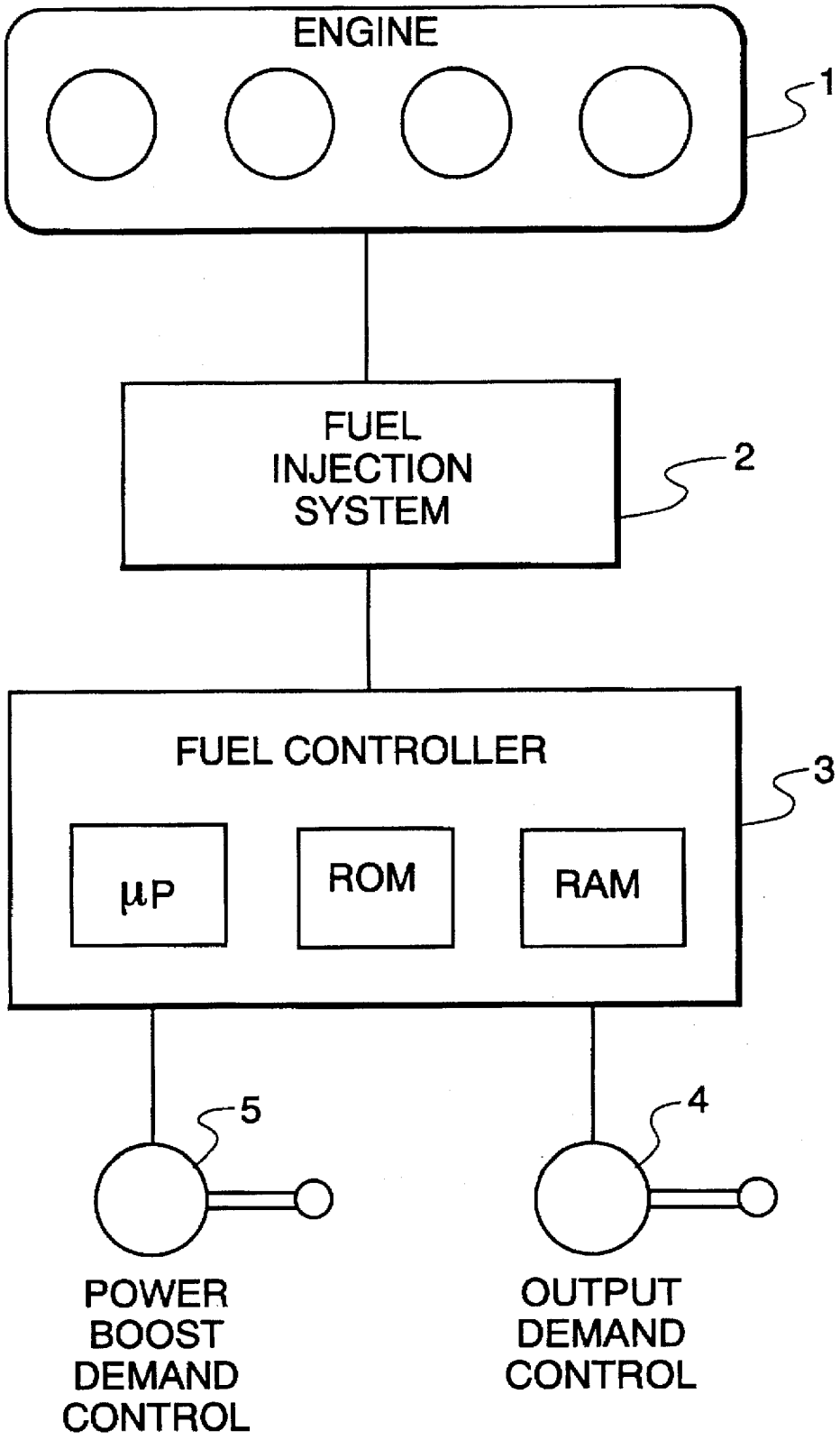
FIG. 1 is a block schematic diagram of an engine management system including a controller for power boost operation constituting an embodiment of the invention.

An agricultural tractor (not shown) includes a compression-ignition engine 1 provided with a fuel injection system 2. An engine management system in the form of a fuel controller 3 incorporates a microprocessor with input and output interfaces, a read only memory containing an operating programme for the microprocessor, and a random access memory for the microprocessor. A manually operated output demand control 4 is connected to an input of the controller 3 and is adjusted by an operator so as to set a desired engine speed. An engine speed sensor (not shown) supplies signals to the controller 3, which controls the fuel injection system 2 so as to maintain the engine speed at a substantially constant value. A manually operated power boost demand control 5 is connected to the controller 3 and is used by the operator to control a percentage of increased output power demand, for instance when the load on the tractor is too large for the speed selected by the control 4 to be maintained.

Figure 2:
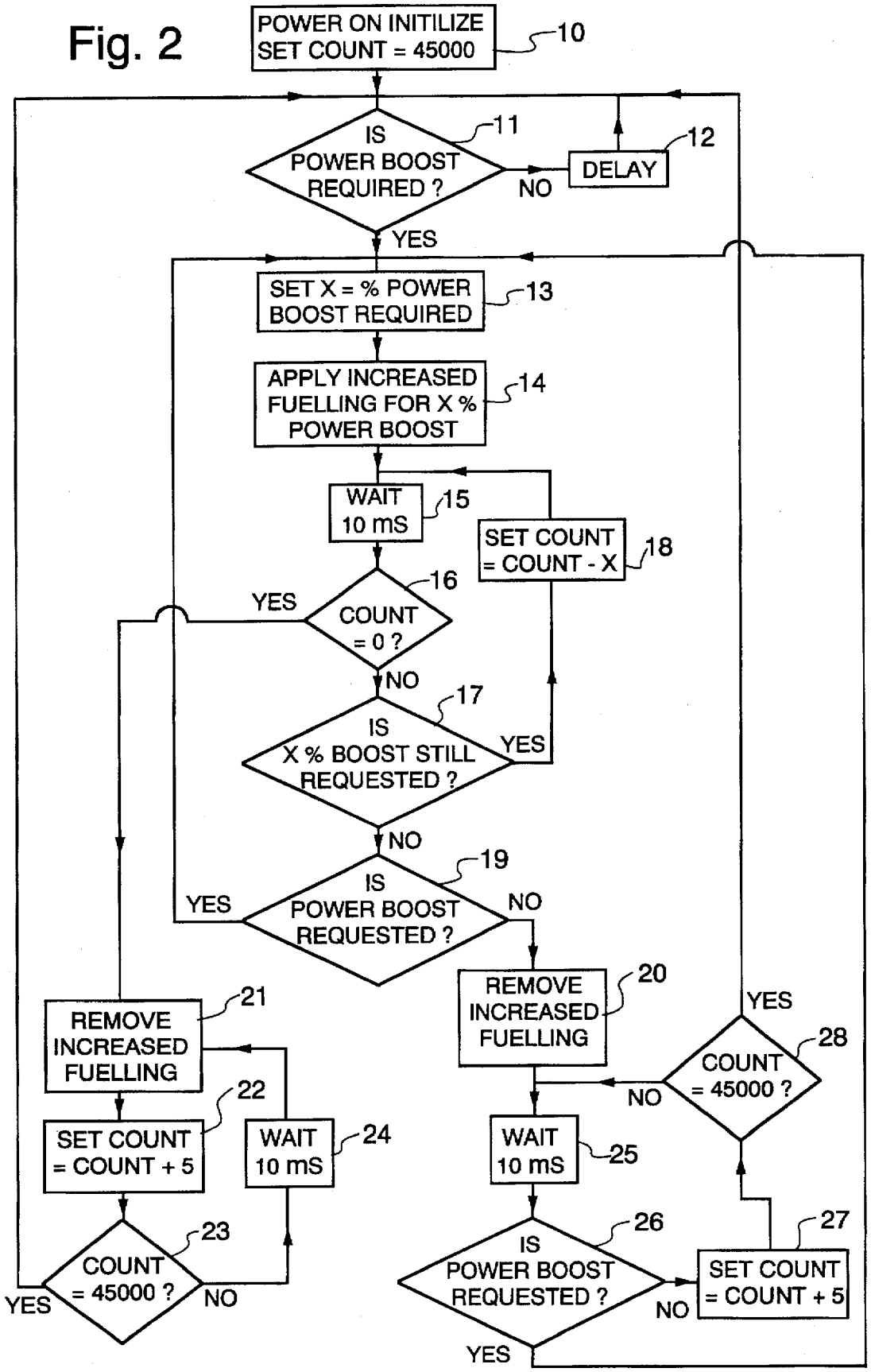
FIG. 2 is a flow diagram illustrating operation of the controller of FIG. 1.

FIG. 2 illustrates part of the operating program stored in the read only memory of the controller 3 for monitoring and controlling power boost operation of the engine 1. Upon applying power to the controller 3, step 10 initializes the controller and, in particular, sets a variable COUNT to 45,000. Step 11 determines whether the control 5 is requesting power boost and if not, this step 11 is repeated after a delay 12. Alternatively, power boost operation may be controlled within an interrupt program. If power boost is required, step 13 sets a variable x to the percentage of power boost which has been demanded by the control 5. Step 14 then causes the fuel injection system 2 to increase the fuelling so as to provide x% power boost by the engine 1. Step 15 causes the controller to wait for 10 milliseconds and step 16 checks whether the variable COUNT has reached zero. If not, step 17 tests whether x% of power boost is still being requested. If so, step 18 decrements the variable COUNT by x and returns control to the step 15. If not, step 19 tests whether power boost is still being requested by the control 5. If so, control is returned to the step 13. If not, control passes to step 20.

The steps 13 to 19 are performed until the request for power boost is removed or the variable COUNT reaches zero. When COUNT reaches zero, the increased fuelling is removed at step 21 and the variable COUNT is incremented by 5 at step 22. Step 23 tests whether the variable COUNT has reached 45,000 and, if not, the controller waits 10 milliseconds in accordance with step 24 before returning control to the step 22. When the variable COUNT reaches 45,000, control is returned to the step 11 so as to wait for the next request for power boost. Thus, the steps 21 to 24 prevent power boost operation for 90 seconds after power boost has been requested for the maximum permissible continuous time.

If the request for power boost is removed before the variable COUNT reaches zero, the step 20 removes the increased fuelling by the fuel injection system 2. The controller then waits 10 milliseconds at step 25 and tests at step 26 whether power boost has been requested again. If so, control passes to the step 13. If not, step 27 increments the variable COUNT by 5 and step 28 tests whether the variable COUNT has reached 45,000. If not, control passes to the step 25. When COUNT reaches 45,000, control returns to the step 11 to await further requests for power boost.

The steps 25 to 28 return the variable COUNT to its maximum value at the same rate as the steps 22 to 24 but, because the maximum permissible power boost operation time was not reached during power boost operation, further requests for power boost operation are implemented immediately but with the current value of the variable COUNT. The permitted maximum time for power boost operation is thus dependent on the recent history of power boost operation of the engine.

Figure 3:
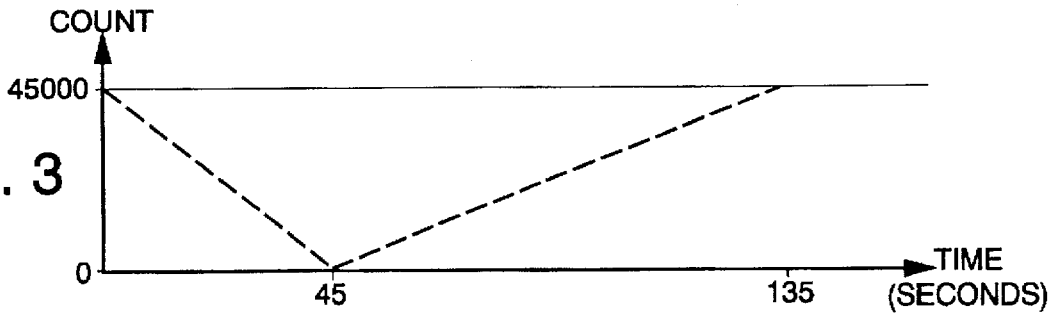
FIGS. 3 through 6 are graphs of a variable COUNT against time in seconds illustrating operation of the controller of FIG. 1.

FIGS. 3 to 6 illustrate power boost operation starting with a power boost request at zero time with the variable COUNT set to 45,000. In FIG. 3, a 10% power boost request is demanded by the control 5. The step 13 sets the variable x to 10. Power boost operation continues for 45 seconds, as determined by the steps 15 to 18, until the variable COUNT reaches zero. The step 21 then removes the increased fuelling so as to terminate a power boost operation, irrespective of the operation of the control 5. The steps 22 to 24 then cause the variable COUNT to be returned to the maximum value of 45,000 in a period of 90 seconds, after which the controller will implement further requests for power boost operation.

Figure 4:
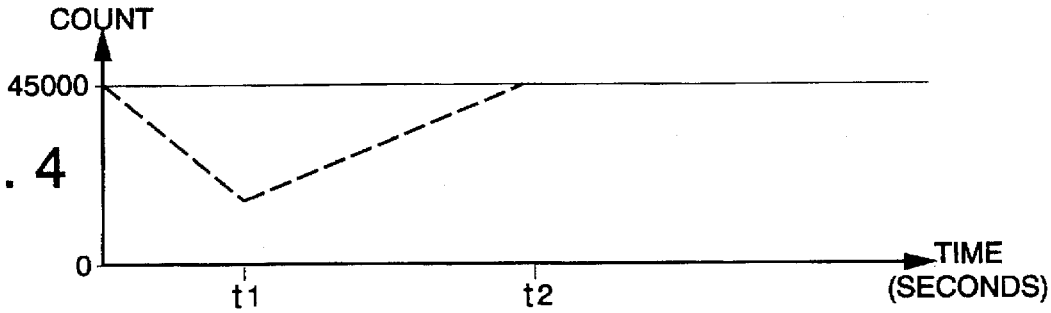

FIG. 4 illustrates a request for 10% of power boost operation which is removed after a time t1 less than 45 seconds. The increased fuelling is removed by the step 20 at time t1 and the steps 25 to 28 cause the variable COUNT to be incremented until it reaches 45,000 at time t2. During the time period from t1 to t2, no further requests for power boost operation are received by the controller.

Figure 5:
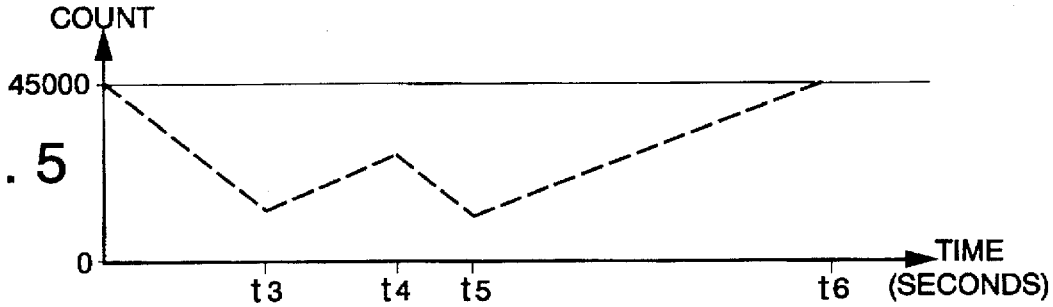

FIG. 5 illustrates operation of the controller when a 10% of power boost request is maintained until a time t3 less than 45 seconds. At the time t3, the request is removed and the steps 25 to 28 cause the variable COUNT to be incremented towards its maximum value. However, at time t4, a further request for 10% power boost operation is received. This is implemented and the steps 15 to 18 cause the variable COUNT to be decremented towards zero again. Before COUNT reaches zero, the power boost request is removed at time t5. The step 20 removes the increased fuelling and steps 25 to 28 cause the variable COUNT to return to its maximum value at time t6.

Figure 6:
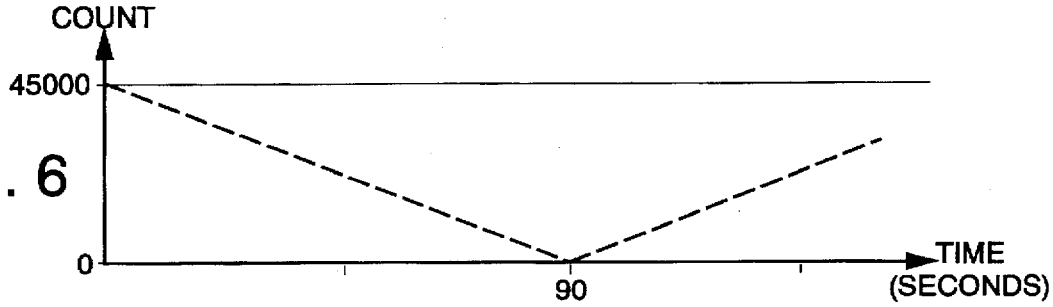

FIG. 6 illustrates operation as a result of a request for 5% power boost operation. The variable COUNT is decremented at half the rate illustrated during 10% power boost operation in FIGS. 3 to 5 and reaches zero after 90 seconds. The increased fuelling is then removed by the step 21 and the steps 22 to 24 cause the variable COUNT to return to 45,000 over the subsequent 90 second period.

Provided the variable COUNT is not decremented to zero, repeated power boost operation is immediately available. Although not illustrated in FIGS. 3 to 6, the steps 17, 19, and 13 permit the amount of power boost to be varied during power boost operation. Varying the percentage of power boost requested causes the rate at which the variable COUNT is decremented to be varied by the step 18. It is also possible to modify the operation of the controller 3 to take into account other factors, such as ambient temperature, which affect the permissible maximum period of power boost operation.

Although the rate at which the variable COUNT returns to its maximum value after power boost operation is fixed in the illustrated embodiment, this may also be varied, for instance by varying the amount of the increment in the steps 22 and 27. For instance, this rate of return may be varied in accordance with the ambient temperature, the time spent in power boost operation, the rate of decrementing in the step 18, or by any combination of such factors.

It is thus possible to provide a controller for power boost operation which automatically prevents overheating of the engine by limiting power boost operation when necessary. The variable COUNT may be considered to represent the integral of excess heat in the engine coolant system. During normal operation in the absence of requests for power boost operation, the heat level is considered to be normal and this is represented by the value 45,000 of COUNT. During power boost operation, COUNT is inversely related to excess heat in the engine coolant system up to a maximum permitted value corresponding to the variable COUNT reaching zero. Following power boost operation, the excess heat is dissipated by the engine coolant system and this is represented by the variable COUNT returning towards the "normal" value of 45,000. The step 16 acts as a comparator which detects when COUNT represents the maximum permissible excess heat in the coolant system and the steps 22 to 24 simulate a timer which prevents further power boost operation until the excess heat has been removed. The steps 15 to 18 may be considered as representing a timer which times the power boost operation.

Controls of the type described hereinbefore may be used with any type of internal combustion engine which is capable of providing power boost operation as a result of manual demands but which cannot maintain such operation indefinitely. It will be appreciated that opposed to manual demands, a power boost request also may be generated automatically, such as by means of a tractor control system having control over as well the engine as the transmission, without departing from the scope of the invention.

Having thus described the invention, what is claimed is:

1. Controller means for controlling power boost operation of an internal combustion engine by increasing fuelling, including a fuel controller for controlling the rate of fuel supplied to the engine and for supplying an increased rate of fuel in response to a power boost demand signal, comprising:

a first timer for measuring a first time period during which the power boost demand signal is supplied to the fuel controller;

a comparator for supplying a prevent boost signal when the first time period exceeds a maximum boost time period;

a second timer for preventing the fuel controller from supplying the increased rate of fuel for a second time period in response to the prevent boost signal; and a power boost demand control operable to generate said power boost demand signal, said power boost demand control being adjustable in magnitude, said magnitude representing a percentage of increased engine power demand.

2. The controller means of claim 1 wherein said maximum boost time period is inversely proportional to the magnitude of the power boost demand signal.

3. The controller means of claim 2 wherein said maximum boost time period is dependent on ambient temperature.

4. The controller means of claim 1 wherein said second time period is variable and is dependent on either ambient temperature, or the magnitude of the power boost demand signal, or the recent history of power boost operation, or any combination of these parameters.

5. The controller means of claim 4 wherein said controller means further comprises:

a third timer operable when the power boost signal is interrupted before the first time period reaches the maximum boost time period, to measure a third time period during which no power boost is requested, said third time period being proportionally deducted from said first time period to increase the difference between said first time period and said maximum boost time period.

6. The controller means of claim 5 wherein the third time periods during which no power boost is requested may be followed by first time periods during which a power boost is requested for as long as the accumulated first time period does not exceed said maximum boost time period.

7. The controller means of claim 6 wherein said first and second timers respectively include a counter arranged to count from a first predetermined count towards a second predetermined count in the presence of a power boost demand signal, and from the second predetermined count towards the first predetermined count when the counter has reached the second predetermined count.

8. The controller means of claim 7 wherein said third timer includes a counter arranged to count from an intermediate count inbetween the first and second predetermined count towards the first predetermined count upon the power boost demand signal being interrupted before the second predetermined count has been reached.

9. The controller means of claim 8 characterized in that said second predetermined count corresponds to said maximum boost time period.

10. A method of controlling a power boost operation of an internal combustion engine by increasing fuelling, said engine including a fuel controller for controlling the rate of fuel supplied to the engine, comprising the steps of:

generating a power boost demand signal;

timing a first time period during which said power boost demand signal is generated;

supplying an increased rate of fuel to said engine during said first time period;

generating a prevent boost signal when said first time period exceeds a maximum boost time period;

preventing said supplying step for a timed second time period in response to said prevent boost signal being generated;

upon the power boost demand signal being interrupted before said first time period exceeding said maximum boost time period, measuring a third time period during which no power boost demand signal is generated; and deducting said third time period from said first time period to increase the difference between said first time period and said maximum boost time period.

11. The method of claim 10 further comprising the step of:

allowing third time periods to be followed by first time periods for as long as the accumulated first time period does not exceed said maximum boost time period.

12. The method of claim 11 wherein said step of timing a first time period includes the step of counting from a first predetermined count towards a second predetermined count in the presence of a power boost demand signal; and said step of timing said second time period includes the step of counting from said second predetermined count towards said first predetermined count.

13. The method of claim 12 further comprising the step of:

discontinuing the first counting step upon the power boost demand signal being interrupted before said second predetermined count is reached.

14. The method of claim 13 further comprising the steps of:

setting a variable to the percentage of power boost demanded by said power boost demand signal; and effecting said first counting step by steps equal to said variable.

15. The method of claim 14 wherein said variable may be varied during said power boost operation.

* * * * *